US007466931B2

(12) United States Patent
Park

(10) Patent No.: US 7,466,931 B2
(45) Date of Patent: Dec. 16, 2008

(54) APPARATUS AND METHOD FOR CONTROLLING LASER SCANNING UNIT

(75) Inventor: Young-kook Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 211 days.

(21) Appl. No.: 11/435,873

(22) Filed: May 18, 2006

(65) Prior Publication Data

US 2006/0269299 A1 Nov. 30, 2006

(30) Foreign Application Priority Data

May 26, 2005 (KR) ..... 10-2005-0044459

(51) Int. Cl.
*G03G 15/00* (2006.01)

(52) U.S. Cl. ..... 399/12

(58) Field of Classification Search ..... 399/12, 399/13

See application file for complete search history.

(56) References Cited

U.S. PATENT DOCUMENTS 5,708,922 A * 1/1998 Azuma et al. ..... 399/111
6,285,836 B1 * 9/2001 Kubota ..... 399/12

FOREIGN PATENT DOCUMENTS

| | | | |
|---|---|---|---|
| JP | 05035007 A | * | 2/1993 |
| JP | 05345458 A | * | 12/1993 |
| JP | 11-015352 | | 1/1999 |
| JP | 11-167266 | | 6/1999 |
| JP | 2000-112317 | | 4/2000 |
| JP | 2004-020614 | | 1/2004 |
| JP | 2004-061660 | | 2/2004 |

* cited by examiner

*Primary Examiner*—Ryan Gleitz
(74) *Attorney, Agent, or Firm*—Stein, McEwen & Bui, LLP

(57) ABSTRACT

A laser scanning unit (LSU) control apparatus for controlling a laser scanning unit (LSU) in an electro-photographic image forming apparatus in which an installed developer forms an image by developing a result obtained by driving the LSU includes: a sensing unit sensing whether the developer is installed and whether a cover of the image forming apparatus is open or closed; an examining unit examining whether installation of the developer and closure of the cover are sensed; and an LSU driver driving the LSU by being switched in response to the examination result. An LSU control method includes sensing whether the developer is installed and the cover is closed, determining whether both the developer is installed and the cover is closed and driving the LSU if it is determined that both the developer is installed and the cover is closed.

9 Claims, 4 Drawing Sheets

APPARATUS AND METHOD FOR CONTROLLING LASER SCANNING UNIT

CROSS-REFERENCE TO RELATED APPLICATION

This application claims the benefit of Korean Patent Application No. 200544459, filed on May 26, 2005 in the Korean Intellectual Property Office, the disclosure of which is incorporated herein in its entirety by reference.

BACKGROUND OF THE INVENTION

1. Field of the Invention

Aspects of the present invention relate to an image forming apparatus such as a printer, and more particularly, to a laser scanning unit (LSU) control apparatus and method for controlling an LSU only when installation of a developer and closure of a cover are sensed.

2. Description of the Related Art

FIGS. 1A and 1B are reference diagrams for explaining a conventional LSU control apparatus. An LSU 100 scans light to form electrostatic latent images on a photosensitive medium 110. A cover 120 allows a user to access the inside of an image forming apparatus by enabling the image forming apparatus to be opened and closed from the outside. A first switching unit 130 cuts off +24V power to a motor 103 of the LSU 100 using a micro switch when the cover 120 is open. A second switching unit 140 cuts off +5V power to a laser diode 106 of the LSU 100 using a micro switch when the cover 120 is opened. A power supply 150 supplies power to the LSU 100.

Both the first switching unit 130 and the second switching unit 140 operate in response to whether the cover 120 is open or closed, and during their operation, an undesired in-rush current can flow briefly through the laser diode 106. Thus, in the conventional LSU control apparatus, the laser diode 106 can be damaged by the undesired in-rush current, which can be a serious problem, since laser diode 106 can be expensive.

In addition, if a developer is installed in the conventional LSU control apparatus, the LSU 100 can begin exposure when the cover 120 is open. This can expose users to harmful materials.

SUMMARY OF THE INVENTION

Aspects of the present invention provide a laser scanning unit (LSU) control apparatus that prevents damage to a laser diode by in-rush current and that drives an LSU only when installation of a developer and closure of a cover are sensed.

Aspects of the present invention also provide a laser scanning unit (LSU) control method that prevents damage to a laser diode by in-rush current and that drives an LSU only when installation of a developer and closure of a cover are sensed.

Aspects of the present invention also provide a computer readable recording medium storing a computer readable program that prevents damage to a laser diode by in-rush current and that drives a laser scanning unit (LSU) only when installation of a developer and closure of a cover are sensed.

According to an aspect of the present invention, there is provided an apparatus for controlling a laser scanning unit (LSU) in an electro-photographic image forming apparatus in which an installed developer forms an image by developing a result obtained by driving the LSU, the LSU control apparatus comprising: a sensing unit that senses whether the developer is installed and whether a cover of the image forming apparatus is closed; an examining unit that provides an examination result based on whether installation of the developer and closure of the cover are sensed; and an LSU driver that drives the LSU by being switched in response to the examination result.

According to an aspect of the present invention, the LSU driver may comprise: a first switching unit that is switched in response to whether the developer is installed; and a second switching unit switched in response to the examination result, wherein when the second switching unit is closed, the LSU is driven through the closed first switching unit.

According to an aspect of the present invention, the sensing unit may comprise: an installation sensing unit that senses whether the developer is installed; and an open/closed sensing unit, which is separate from the installation sensing unit and senses whether the cover is closed.

According to an aspect of the present invention, the installation sensing unit may comprise at least one contact sensor that senses the installed developer. The examining unit may examine whether the installation of the developer is sensed and whether the closure of the cover is sensed.

According to an aspect of the present invention, the LSU control apparatus may further comprise: a user interface unit informing a user that the LSU cannot be driven if the examination result provided by the examining unit indicates that the developer is not installed or the cover is not closed.

According to another aspect of the present invention, there is provided a method of controlling a laser scanning unit (LSU) in an electro-photographic image forming apparatus in which an installed developer forms an image by developing a result obtained by driving the LSU, the LSU control method comprising: sensing whether the developer is installed and whether a cover of the image forming apparatus is closed; determining whether both installation of the developer and the closure of the cover are sensed; and driving the LSU if it is determined that both the installation of the developer and the closure of the cover are sensed.

According to an aspect of the present invention, the LSU control method may further comprise providing a notification that the LSU cannot be driven if it is determined that either the installation of the developer or the closure of the cover is not sensed. In the driving, if it is determined that the closure of the cover is sensed after the installation of the developer is sensed, the LSU may be driven.

According to another aspect of the present invention, there is provided a computer readable recording medium storing a computer readable program that performs a method of controlling a laser scanning unit (LSU) in an electro-photographic image forming apparatus in which an installed developer forms an image by developing a result obtained by driving the LSU, the LSU control method comprising: sensing whether the developer is installed and whether a cover of the image forming apparatus is closed; determining whether both installation of the developer and closure of the cover are sensed; and driving the LSU if it is determined that both the installation of the developer and the closure of the cover are sensed.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 1A is a cross-sectional representation of a conventional image forming apparatus and FIG. 1B is a block diagram of a conventional LSU control apparatus.

DETAILED DESCRIPTION OF THE EMBODIMENTS

Figure 1A:
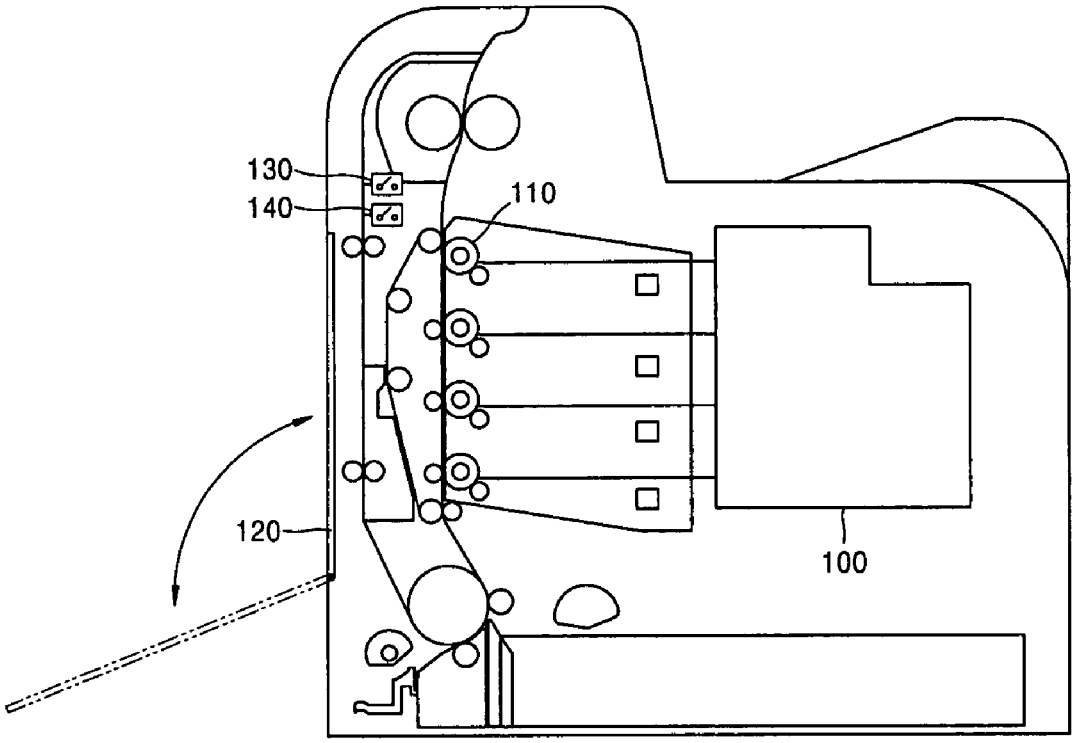
FIG. 1A (PRIOR ART)
FIGS. 1A and 1B are reference diagrams for explaining a conventional LSU control apparatus where
Figure 1B:
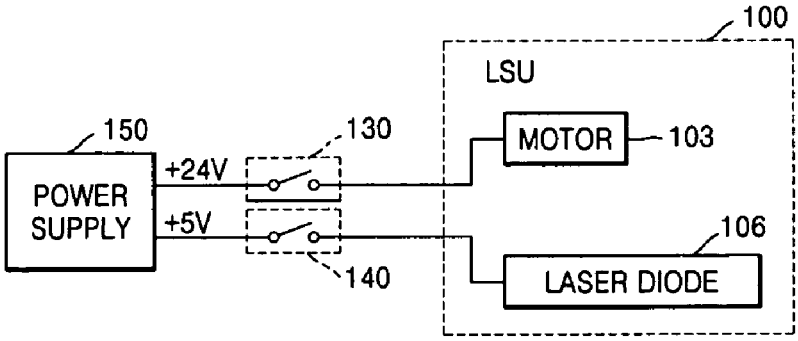
FIG. 1B (PRIOR ART)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
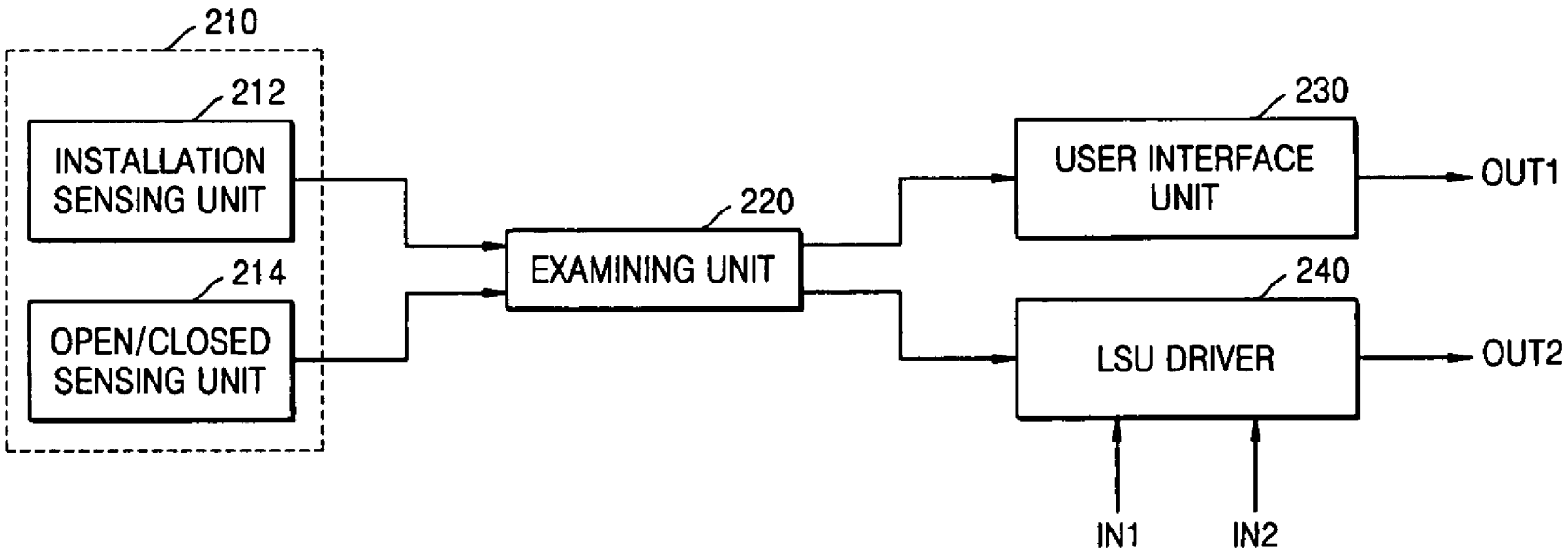
FIG. 2 is a block diagram of an LSU control apparatus according to an embodiment of the present invention.

FIG. 2 is a block diagram of an LSU control apparatus according to an embodiment of the present invention. The LSU control apparatus includes a sensing unit 210, an examining unit 220, a user interface unit 230, and an LSU driver 240. While not required in all aspects, the LSU control apparatus may be included in an electro-photographic image forming apparatus having an LSU. In this embodiment, the LSU includes a motor (not shown) and a laser diode (not shown). A laser printer is an example of the electro-photographic image forming apparatus that contains an LSU. However, it is to be understood that the LSU can be included in a multifunctional device that has scanning, copying and/or fax capabilities.

The image forming apparatus further includes a developer and a cover. The developer is removably installed in the image forming apparatus, and the cover is attached to a housing of the image forming apparatus so that the cover can be opened and closed from the outside. That is, a user can install the developer in the image forming apparatus by opening the cover and inserting the developer into the image forming apparatus.

The LSU forms an electrostatic latent image by scanning light on a photosensitive medium, and the installed developer forms an image by developing the electrostatic latent image. According to aspects of the present invention, a configuration satisfying the conditions for driving the LSU is described below.

The sensing unit 210 includes an installation sensing unit 212, which senses whether the developer is installed. The sensing unit 210 also includes an open/closed sensing unit 214 that senses whether the cover is closed.

In more detail, the installation sensing unit 212 senses whether the developer is installed in the image forming apparatus. To do this, at least one contact sensor (not shown) may be located in the developer. If the developer is installed, the contact sensor senses a contact with the inner surface of the image forming apparatus. Alternatively, a contact sensor may be provided on the inner surface of the image forming apparatus to sense a contact with a developer. The contact sensed by the contact sensor can be represented by a voltage. When the voltage varies abruptly, the contact sensor recognizes that the developer has been installed. While a contact sensor is described herein, it is to be understood that other detection mechanisms can be used, such as optical sensors.

The open/closed sensing unit 214 senses whether the cover is open or closed. To do this, an open/closed sensor (not shown) can be located on the cover or on a surface of the housing of the image forming apparatus contacted by the cover in the closed position.

If a developer is newly installed and then the cover is closed, the sensing unit 210 senses the installation of the developer and then the closure of the cover. However, if a developer has been previously installed and the cover has been kept closed, the sensing unit 210 can sense that the cover is closed and that the developer is present. In this case, the sensing unit 210 can sense the installation of the developer and then the closure of the cover or can simultaneously sense the installed status of the developer and the closed status of the cover.

The examining unit 220 examines whether the installation of the developer and the closure of the cover are sensed by the sensing unit 210. Here, if a developer is newly installed and then the cover is closed, the examining unit 220 can examine whether the closure of the cover is sensed by sensing unit 210 after the installation of the developer is sensed.

The user interface unit 230 provides a user interface informing a user that the LSU cannot be driven, in response to the examination result of the examining unit 220. That is, the user interface unit 230 operates when the examining unit 220 determines that either the installation of the developer or the closure of the cover is not sensed. OUT1 denotes a user interface provided by the user interface unit 230. The interface unit 230 can include a display that displays the message, or the interface unit 230 may send a message to an external display.

The LSU driver 240 drives the LSU by being switched in response to the examination result of the examining unit 220. That is, the LSU driver 240 can drive the LSU only if the examination result of the examining unit 220 satisfies a predetermined condition. This condition is that both the installation of the developer and the closure of the cover are sensed. In particular, if a developer is newly installed and then the cover is closed, the condition is that the closure of the cover is sensed after the installation of the developer is sensed. OUT2 denotes the result wherein the LSU driver 240 drives the LSU. IN1 and IN2 respectively denote a first driving voltage and a second driving voltage, which will be described below.

Figure 3:
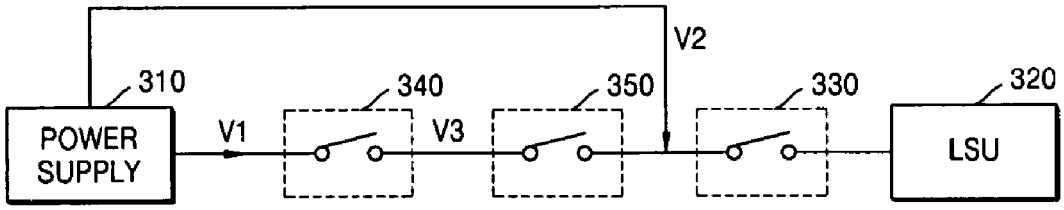
FIG. 3 is a block diagram showing the LSU driver illustrated in FIG. 2.

FIG. 3 is a block diagram showing greater detail of the LSU driver 240 illustrated in FIG. 2. The LSU driver 240 includes a power supply 310, an LSU 320, a first switching unit 330, and second switching units 340 and 350. It is preferable, but not necessary that the LSU driver 240 includes all of the items shown in FIG. 3. Moreover, while not required in all aspects, the first switching unit 330 and the second switching units 340 and 350 can each include at least one switch.

The power supply 310 can supply IN1 and IN2 to the LSU driver 240 and the LSU 320. V1 denotes the first driving voltage IN1, and V2 denotes the second driving voltage IN2. For example, V1 can be +24V, and V2 can be +5V. The power supply 310 can be a switching mode power supply (SMPS).

It is preferable, but not necessary, that the LSU 320 includes a laser diode (not shown). Thus, the term driving the LSU 320 refers to driving the laser diode. V1 can drive a motor (not shown) in the LSU 320, and V2 can drive the laser diode in the LSU 320.

However, V2 is not directly input to the LSU 320. Instead, V2 is input via the first switching unit 330, and only if both the first switching unit 330 and the second switching units 340 and 350 are closed.

The first switching unit 330 is switched in response to whether the developer is installed. That is, the first switching unit 330 is closed only if the developer is installed.

The second switching units 340 and 350 are switched in response to the examination result of the examining unit 220. That is, the second switching units 340 and 350 are closed only if the examining unit 220 determines that both the installation of the developer and the closure of the cover are sensed. If the second switching units 340 and 350 are closed, V2 is supplied to the LSU 320 via the second switching units 340 and 350.

The second switching units 340 and 350 can include a first switch 340 and a second switch 350. However, this is for convenience of description, and the second switching units 340 and 350 can be composed of one switch or a plurality of switches. However, it is to be understood that other elements can be used to selectively interrupt current.

The first supply voltage V1 is applied to one end of the first switch 340 from the power supply 310, and when the first switch 340 is closed, a third supply voltage V3 is sensed at the other end of the first switch 340. By way of example, the first switch 340 is closed only if the closure of the cover is sensed. If it is assumed that V1 is +24V, V3 can be called +24 VS.

Figure 4:
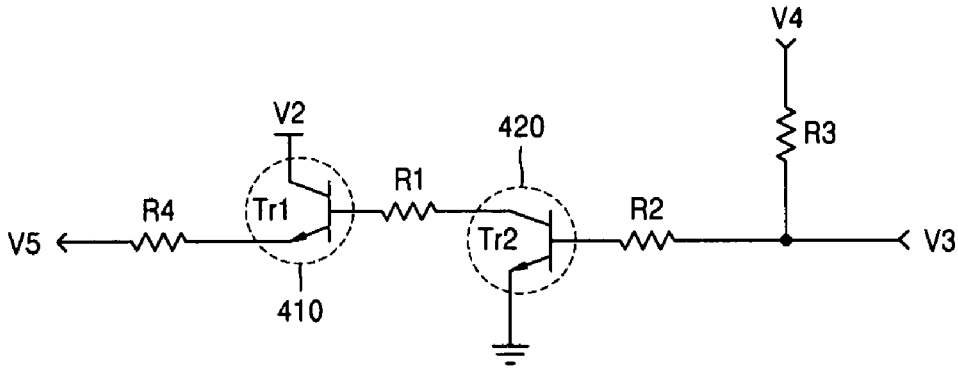
FIG. 4 is circuit diagram of a second switch illustrated in FIG. 3.

The second switch 350 is closed only if both the installation of the developer and the closure of the cover are sensed. FIG. 4 is an example of the second switch 350 illustrated in FIG. 3. Referring to FIG. 4, the second switch 350 can be implemented by a first transistor 410, a second transistor 420, and a plurality of resistors. Optionally, the second transistor 420 can be omitted.

The first transistor 410 and the second transistor 420 can be bipolar junction transistors or metal oxide semiconductor field-effect transistors (MOSFETs), and preferably, but not necessarily, operate as switches. If both the first transistor 410 and the second transistor 420 are switched on, V2 is output as a voltage V5 via a resistor R4. Here, the voltage V5 drives the laser diode of the LSU 320. The second transistor 420 is switched on only if V4 is applied to the second transistor 420 via a resistor R3 and a resistor R2. Here, V4 is a voltage generated only when the closure of the cover is sensed.

Figure 5:
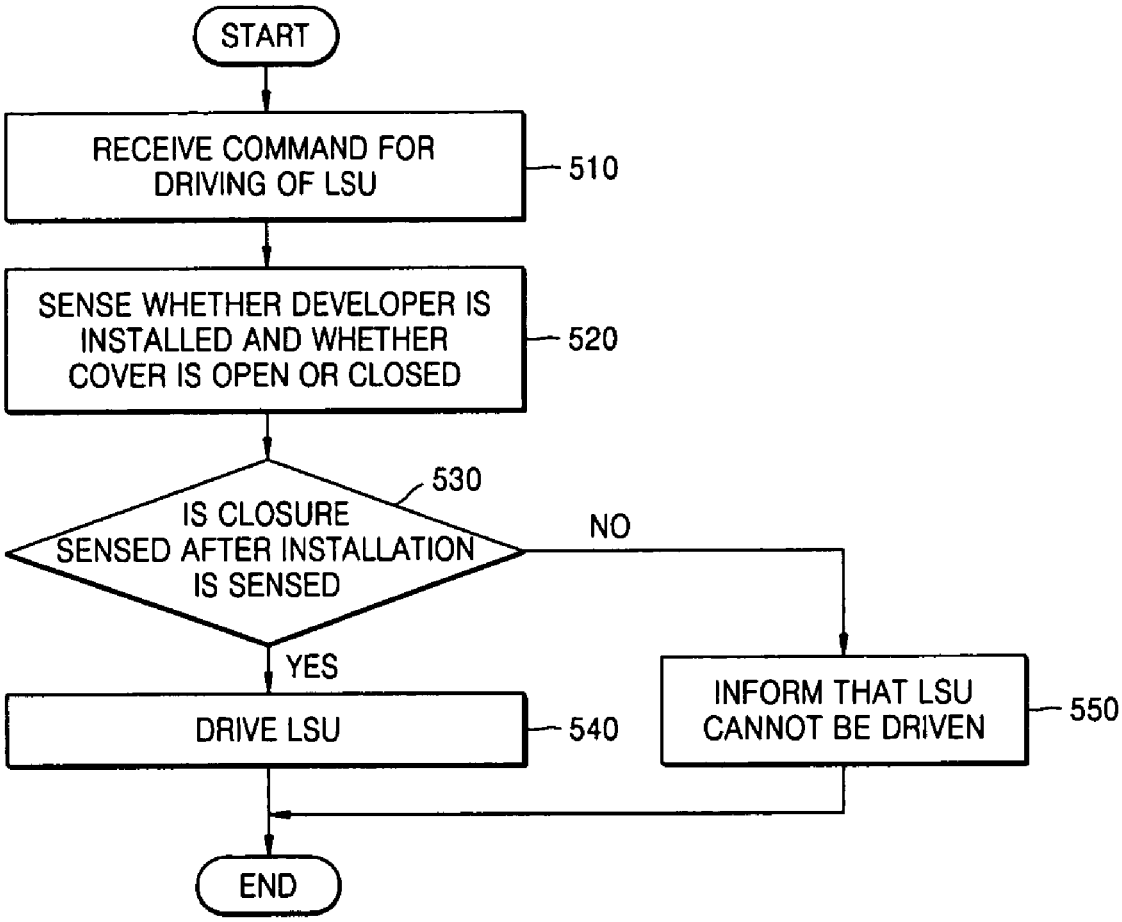
FIG. 5 is a flowchart illustrating an LSU control method according to an embodiment of the present invention.

FIG. 5 is a flowchart illustrating an LSU control method according to an embodiment of the present invention. The LSU control method includes determining whether installation of the developer and closure of the cover are sensed in operations 510 through 530 and driving the LSU 320 according to the determination result in operations 540 and 550.

In operation 510, if a host (such as, for example, a computer) connected to the image forming apparatus commands the image forming apparatus to operate the LSU 320, in operation 520, the sensing unit 210 senses whether the developer is installed and whether the cover is open or closed. In operation 530, the examining unit 220 determines whether the installation of the developer and the closure of the cover are sensed. If the developer is newly installed, the examining unit 220 determines whether the closure of the cover is sensed after the installation of the developer is sensed.

If it is determined that the installation of the developer and the closure of the cover are sensed in operation 530, the LSU driver 240 begins exposure by driving the LSU 320, in operation 540.

If it is determined that the installation of the developer or the closure of the cover is not sensed in operation 530, the user interface unit 230 in operation 550 provides a notification that the LSU driver 240 cannot drive the LSU 320, and the operation 540 of driving the LSU is not carried out.

Aspects of the present invention may be embodied in a general-purpose computer by running a program from a computer-readable medium, including but not limited to storage media such as magnetic storage media (ROMs, RAMs, floppy disks, magnetic tapes, etc.), optically readable media (CD-ROMs, DVDs, etc.), and carrier waves (transmission over the internet). Aspects of the present invention may be embodied as a computer-readable medium having a computer-readable program code unit embodied therein for causing a number of computer systems connected via a network to effect distributed processing. The functional programs, code and code segments for embodying aspects of the present invention may be easily construed by programmers skilled in the art to which aspects of the present invention belong.

As described above, In an LSU control apparatus and method according to aspects of the present invention, a contact sensor can be used to sense whether a developer is installed or not. In addition, the LSU never operates when no developer is installed or the cover is not closed. In other words, operation of the LSU is prevented when the developer is installed but the cover is still open, thereby preventing users from being exposed to harmful materials. In addition, by determining whether power is supplied to a laser diode of the LSU and driving the laser diode via a switching unit which is closed by installation of the developer, damage to the laser diode by in-rush current is prevented.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus that controls a laser scanning unit in an electro-photographic image forming apparatus in which an installed developer forms an image by developing a result obtained by driving the laser scanning unit, the laser scanning unit control apparatus comprising:

a sensing unit that senses whether the developer is installed and whether a cover of the image forming apparatus is closed;

an examining unit that provides an examination result based on whether a condition is met wherein both the developer is installed and the cover is closed as sensed by the sensing unit; and a laser scanning unit driver that drives the laser scanning unit and that is switched to selectively drive or not drive the laser scanning unit in response to the examination result, wherein the laser scanning unit driver comprises:

a first switching unit that is switched in response to whether the developer is installed; and a second switching unit that is switched in response to the examination result, wherein when the second switching unit is closed, the laser scanning unit is driven through the closed first switching unit.

2. The laser scanning unit control apparatus of claim 1, wherein the sensing unit comprises:

an installation sensing unit that senses whether the developer is installed; and an open/closed sensing unit that is separate from the installation sensing unit and that senses whether the cover is closed.

3. The laser scanning unit control apparatus of claim 2, wherein the installation sensing unit comprises at least one contact sensor that senses the installed developer.

4. The laser scanning unit control apparatus of claim 1, wherein the examining unit determines whether closure of the cover is sensed after the installation of the developer is sensed.

5. The laser scanning unit control apparatus of claim 1, further comprising:

a user interface unit that informs a user that the laser scanning unit cannot be driven in response to an examination result based on a condition in which either the developer is not installed or the cover is not closed.

6. A method of controlling a laser scanning unit in an electro-photographic image forming apparatus in which an installed developer forms an image by developing a result obtained by driving the laser scanning unit, the laser scanning unit control method comprising:

sensing whether the developer is installed and sensing whether a cover of the image forming apparatus is closed;

determining whether both installation of the developer and closure of the cover are sensed;

closing a first switching unit only when the developer is installed and closing a second switching unit only when it is determined that both the installation of the developer and the closure of the cover are sensed; and driving the laser scanning unit through the closed first switching unit if it is determined that both the installation of the developer and the closure of the cover are sensed.

7. The laser scanning unit control method of claim 6, further comprising providing a notification that the laser scanning unit cannot be driven if it is determined either the installation of the developer or the closure of the cover is not sensed.

8. The laser scanning unit control method of claim 6, wherein in the driving, the laser scanning unit is driven if it is determined that the closure of the cover is sensed after the installation of the developer is sensed.

9. A computer readable recording medium storing a computer readable program that performs a method of controlling a laser scanning unit in an electro-photographic type image forming apparatus in which an installed developer forms an image by developing a result obtained by driving the laser scanning unit, the laser scanning unit control method comprising:

sensing whether the developer is installed and sensing whether a cover of the image forming apparatus is closed;

determining whether both installation of the developer and closure of the cover are sensed;

closing a first switching unit only when the developer is installed and closing a second switching unit only when it is determined that both the installation of the developer and the closure of the cover are sensed; and driving the laser scanning unit through the closed first switching unit if it is determined that both the installation and the closure are sensed.

* * * * *